US007797086B2

(12) United States Patent
Lorido et al.

(10) Patent No.: US 7,797,086 B2
(45) Date of Patent: Sep. 14, 2010

(54) PROCESS TO AVOID CONFUSION BETWEEN LANDING RUNWAYS

(75) Inventors: Didier Lorido, Plaisance du Touch (FR); Stéphane Bertheau, Toulouse (FR)

(73) Assignee: Thales (FR)

( * ) Notice: Subject to any disclaimer, the term of this patent is extended or adjusted under 35 U.S.C. 154(b) by 795 days.

(21) Appl. No.: 11/614,032

(22) Filed: Dec. 20, 2006

(65) Prior Publication Data

US 2007/0142982 A1 Jun. 21, 2007

(30) Foreign Application Priority Data

Dec. 20, 2005 (FR) ..... 05 12962

(51) Int. Cl.
*G01C 21/00* (2006.01)
*B64D 45/04* (2006.01)

(52) U.S. Cl. ..... 701/16; 340/963

(58) Field of Classification Search ..... None
See application file for complete search history.

(56) References Cited

U.S. PATENT DOCUMENTS

| | | | | |
|---|---|---|---|---|
| 5,687,149 | A | 11/1997 | Meunier | |
| 6,088,654 | A | 7/2000 | Lepere et al. | |
| 6,304,800 | B1 * | 10/2001 | Ishihara et al. | 701/16 |
| 6,317,663 | B1 | 11/2001 | Meunier et al. | |
| 6,480,120 | B1 | 11/2002 | Meunier | |
| 6,978,205 | B2 * | 12/2005 | Ryan et al. | 701/120 |
| 7,120,540 | B2 | 10/2006 | Meunier | |
| 7,321,813 | B2 | 1/2008 | Meunier | |
| 7,382,287 | B1 * | 6/2008 | Chen et al. | 340/972 |
| 2004/0044446 | A1 | 3/2004 | Staggs | |
| 2005/0128129 | A1 | 6/2005 | Conner | |
| 2007/0050101 | A1 | 3/2007 | Sacle et al. | |
| 2007/0078590 | A1 | 4/2007 | Meunier | |
| 2007/0078591 | A1 | 4/2007 | Meunier et al. | |
| 2007/0078592 | A1 | 4/2007 | Meunier et al. | |
| 2007/0185652 | A1 | 8/2007 | Salmon et al. | |

FOREIGN PATENT DOCUMENTS

| | | |
|---|---|---|
| EP | 0674300 | 9/1995 |
| FR | 0 674 300 B1 | 6/2005 |

OTHER PUBLICATIONS

U.S. Appl. No. 10/129,089, filed Sep. 30, 2002, Lepere (Abandoned).

* cited by examiner

*Primary Examiner*—Michael J. Zanelli
(74) *Attorney, Agent, or Firm*—Lowe Hauptman Ham & Berner, LLP

(57) ABSTRACT

The process according to the invention is one of identifying the landing runway for which an aircraft is heading, wherein on the basis of on-board information and at least one database relative to the configuration of the landing airport zone, it is possible to dynamically evaluate the aircraft touchdown point on the ground to identify the runway for which the aircraft is heading.

8 Claims, 1 Drawing Sheet

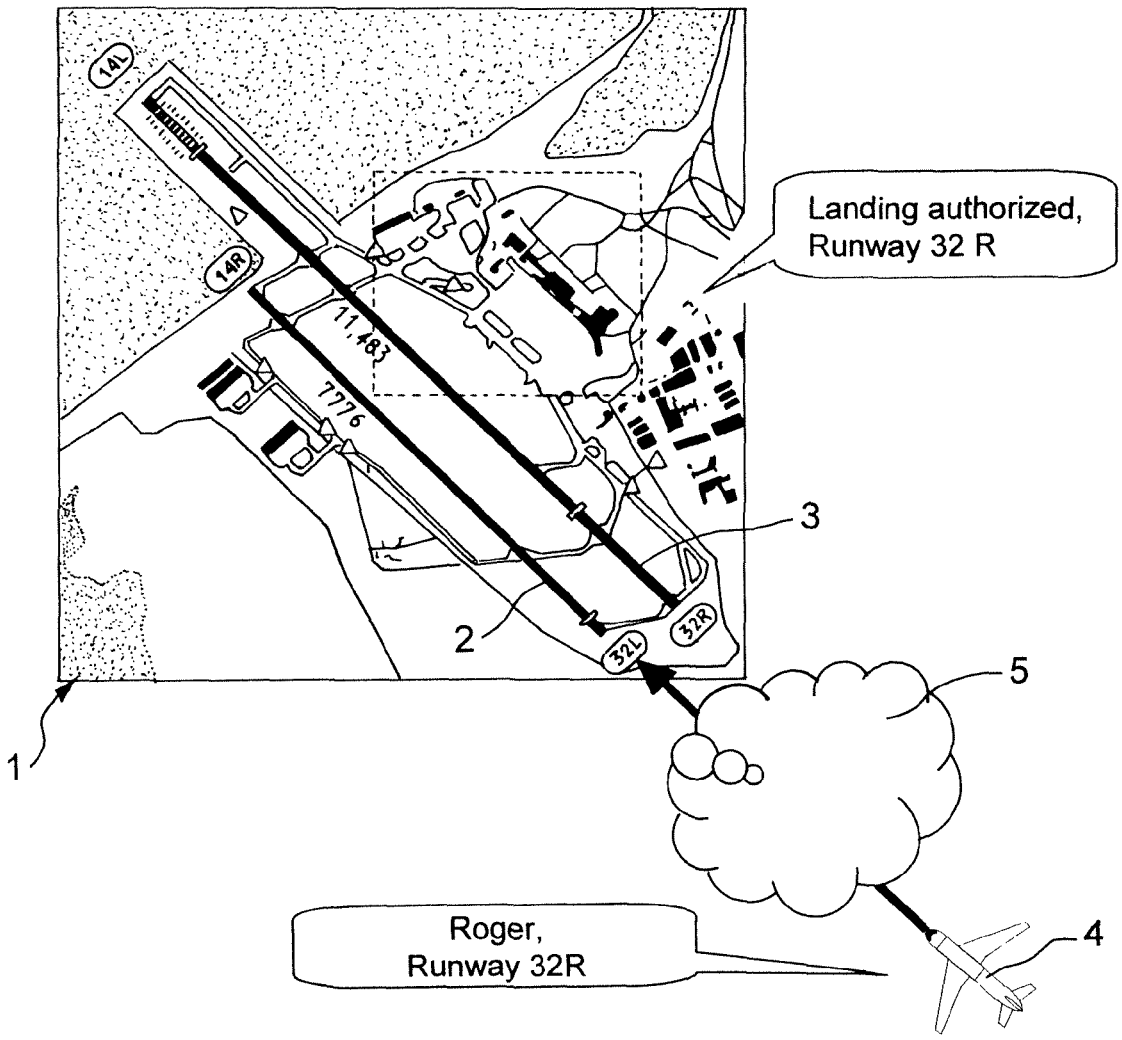
14L
14R
11,483
7776
32L
32R
Landing authorized,
Runway 32 R
Roger,
Runway 32R
1
2
3
4
5

PROCESS TO AVOID CONFUSION BETWEEN LANDING RUNWAYS

RELATED APPLICATIONS

The present application is based on, and claims priority from, France Application Number 05 12962, filed Dec. 20, 2005, the disclosure of which is hereby incorporated by reference herein in its entirety.

FIELD OF THE INVENTION

This invention refers to a process of avoiding any confusion between landing runways when approaching an airport having several runways with parallel center-lines.

BACKGROUND OF THE INVENTION

There are several examples of confusion like this, already occurring in airports with at least two landing runways having center-lines near each other (generally only a few degrees apart). These events have demonstrated that it is possible to land on another runway than the one referred to by air traffic control, while remaining convinced of landing on the authorized runway. At present, there is no automatic system or device capable of notifying the pilot of confusion about engaging the center-line of a runway. Only strict compliance with current aeronautical procedures now allows such confusion to be avoided, although the possibility of the crew or the air traffic control people of the airport concerned making a mistake cannot be ruled out, as demonstrated by three reports from the Bureau Enquête Accidents—BEA—indicating (in France alone), a serious incident in 2000 and two other incidents in 2004.

Document US 2005/0128129 A1 refers to a process of locating an aircraft with respect to a runway, capable of notifying the crew in the event of the aircraft being incorrectly located, but this process will not discriminate between two parallel runways. Document US 2004/0044446 A1 describes a process for calculating the touchdown point of an aircraft on a landing runway depending on its glide slope angle, but which does not allow any discrimination between two parallel runways either.

SUMMARY OF THE INVENTION

The purpose of this invention is to describe a process capable of predicting for an aircraft during an approach maneuver to an airport having several runways with center-lines parallel or more or less parallel to each other, the runway toward which the aircraft is really heading, so as to inform the pilot, to improve his perception in terms of navigation and if necessary, to allow a corrective maneuver if this orientation is incompatible with the intentions of the crew or of air traffic control.

The process according to the invention is one of identifying the landing runway to which an aircraft is heading, wherein on the basis of on-board information and at least one database relative to the configuration of the landing airport zone, it is possible to dynamically evaluate the aircraft touchdown point on the ground and identify the runway for which the aircraft is heading.

The process according to the invention is also a process of avoiding touchdown on an abnormal runway in an airport having several runways with parallel center-lines, wherein, from the correlation between the runway for which the aircraft is heading, and the intentions of the pilot, confusion of the runways, if any, can be detected, so that the pilot at the controls gets unambiguous information about the current landing procedure.

In a more detailed manner, the process according to the invention is wherein that from the position and attitude of the aircraft, and all relevant information on board, as soon as approach begins, it is possible to dynamically determine the estimated touchdown point of the aircraft on the runway, by correlating with airport data stored in an on-board database and identify at the earliest the runway with which the aircraft is aligned. This runway identification can then be presented to the crew to improve its perception as it enters the landing approach center-line. This information is also correlated with the known intentions of the crew to detect any confusion between the actual alignment of the aircraft and the alignment desired by the crew so that, in such a case, it would be possible to supply sufficient warning and remove any doubts about the landing procedure in good time.

Although this invention is described with reference to approach to an airport having at least two runways with parallel center-lines, it is clearly understood that it would also be particularly useful for airports having a single runway or several runways with highly different orientations in that it would allow early and clear identification of the landing surface with which the aircraft is lining up, thus improving the perception of the crew with respect to the situation of the aircraft, especially for IFR approach without visibility.

Still other advantages of embodiments according to the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention.

BRIEF DESCRIPTION OF THE DRAWINGS

The present invention is illustrated by way of example, and not by limitation, in the figures of the accompanying drawings, wherein elements having the same reference numeral designations represent like elements throughout and wherein:

The sole figure is an overhead view of the airport installation at Marseille Provence, including two parallel landing runways 5 (RWY 32L and 32R).

DETAILED DESCRIPTION OF THE DRAWINGS

The sole figure represents a partial top view drawing of airport 1, and in particular two landing runways 2 and 3 running almost parallel to each other. An aircraft 4 is approaching airport 1. The air-traffic controller authorizes the pilot to land on the right-hand runway (runway QFU 32R, aligned 315°, having a length of 3500 m). The pilot collates the instructions of the controller ("Roger, RWY 32R"), confirming his intention of landing on this runway. At moment T when aircraft 4 is shown in the drawing it is still possible for it to steer towards either of the two runways. The course (heading corrected for aero logical deviations) of the aircraft allows exact discrimination between the two runways and thus determination of the one toward which the crew is heading. Any event, or any failure to comply with the procedure, can result in confusion about the landing authorization, as in the case shown in the drawing of dense cloud formation 5 and countered by the aircraft shortly after moment T and concealing runway 32R, but not runway 32L. This situation is similar to the one reported by BEA, in which the circumstances misled the pilot (PF), who naturally opted for the heading of runway 32L while being convinced of being aligned with runway 32R. Of course, this is not the only example. Many other cases (two in 2005 in France alone) of confusion between runways have already been reported, resulting from a great variety of causes (incorrect understanding of air-traffic controller's instructions, incorrect selection of runway number by pilot on radio guided approach, . . . ).

The means described below make it possible to inform the pilot automatically on the runway with which the aircraft is aligned and detect any inconsistency between this alignment and the known intentions of the pilot.

Among the various data available on the aircraft, this invention uses two types of information. The first type derives from a global aeronautical database supplying, in particular, the configuration of the 35 runways of all the different airports (geographical coordinates, QFUs, length of runway, deviation, angle, distance between runways, radio navigation frequencies, etc). The second type is produced by any on-board equipment capable of obtaining information about the situation of the aircraft and the intentions of the crew (instant 4-dimensional geographical position, aircraft altitude, navigation mode, selected frequencies, navigation 5 system data, digital data link exchanges, etc).

According to this invention, a computer on board the aircraft performs the following operations:

1. It correlates the two types of information to determine dynamically the runway on which the aircraft should land when it is in the approach phase. This correlation consists essentially in determining the touchdown point of the aircraft on the ground, taking into consideration the information type 2, then using information type 1 to determine whether this touchdown point clearly identifies the landing runway.
2. It correlates the identification of the track obtained in this way with information type 2 to detect any inconsistency between the intentions of the crew and the maneuvering of the aircraft.
3. If necessary, it displays the identified runway and warns the crew of any detected inconsistency, depending on its type.

Naturally, this determination becomes increasingly accurate as the aircraft approaches the runway and the distance from it, and any induced heading deviation, will gradually be reduced. When the precision associated with the identification of the landing runway makes it possible to obtain with certainty (stable identification over a given period of time allowing for any attitude variations of the aircraft, the precision of the data and the conditions under which the function is activated), the aircraft computer will trigger the following operations:

The computer will inform the crew of the obtained identification of the runway for which the aircraft is heading, for instance, by displaying this name on the "navigation display" in order to inform the pilot about the approach situation.

In the case of an assisted approach (radio guided flight, navigation systems, automatic landing, etc), the identification of the runway is correlated with the information configured on-board (for instance, in the FMS, with information coming from air traffic control, selected radio guidance frequencies, etc.). This enables the computer to produce an appropriate alert, whether visual and/or audible, warning about the possibility of an abnormal runway choice if an anomaly is detected.

It will be readily seen by one of ordinary skill in the art that embodiments according to the present invention fulfill many of the advantages set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

The invention claimed is:

1. A process of avoiding landing runway confusion when approaching an airport having several runways with parallel center-lines, comprising the steps of:

calculating a touchdown point of an aircraft on the ground using information relative to the situation of the aircraft and intention of a pilot of landing on a given runway; and using airport runway configuration information to determine whether the touchdown point identifies the given runway.

2. The process according to claim 1, wherein the calculation of the touchdown point is by correlation with airport data stored in an on-board database.

3. The process according to claim 1, wherein the airport runway identification obtained is correlated with said information relative to the situation of the aircraft and the intentions of the pilot of landing on the given runway to detect any inconsistency between the intentions of the crew and the maneuvering of the aircraft.

4. The process according to claim 3, wherein the process is implemented to avoid landing on a landing runway which is not the given runway on the airport having several runways with center-lines near each other.

5. The process according to claim 1, wherein an on-board computer of the aircraft indicates the identification of the given runway towards which the aircraft is heading.

6. The process according to claim 5, wherein the identification of the given runway towards which the aircraft is heading results in its display on an aircraft display system(s).

7. The process according to claim 1, wherein the identification of the given runway towards which the aircraft is heading is correlated with information configured on-board.

8. The process according to claim 7, wherein a computer produces an appropriate visual and/or audible alarm in the event of there being a risk of landing on a runway which is not the given runway.

* * * * *